US005704476A

United States Patent [19]

Abbott

[11] Patent Number: 5,704,476

[45] Date of Patent: Jan. 6, 1998

[54] HAZARDOUS MATERIAL CONTAINMENT AND STORAGE UNIT

[75] Inventor: Tim Abbott, New Hope, Pa.

[73] Assignee: Tec-Products, Inc., Ellicott City, Md.

[21] Appl. No.: 356,649

[22] Filed: Dec. 15, 1994

[51] Int. Cl.[6] ..... B65D 19/04

[52] U.S. Cl. ..... 206/386; 206/524.5; 206/599; 108/55.3; 220/1.5; 220/23.86; 312/324

[58] Field of Search ..... 206/524.5, 597, 206/386, 599; 220/1.5, 23.83, 23.86; 108/55.3; 312/324

[56] References Cited

U.S. PATENT DOCUMENTS

| | | | |
|---|---|---|---|
| 3,948,190 | 4/1976 | Cook, III et al. | 108/55.3 |
| 4,003,610 | 1/1977 | Main | 312/324 |
| 4,930,632 | 6/1990 | Eckert et al. . | |
| 5,020,667 | 6/1991 | Bush . | |
| 5,036,976 | 8/1991 | Sechler et al. . | |
| 5,092,251 | 3/1992 | Hamaker et al. . | |
| 5,111,937 | 5/1992 | Schutz | 206/386 |
| 5,147,039 | 9/1992 | Sechler et al. . | |
| 5,191,742 | 3/1993 | Romig et al. . | |
| 5,249,699 | 10/1993 | Williams . | |
| 5,254,798 | 10/1993 | Zoback . | |
| 5,307,931 | 5/1994 | Gillispie et al. . | |
| 5,429,236 | 7/1995 | Evans | 206/386 |

FOREIGN PATENT DOCUMENTS

| | | | |
|---|---|---|---|
| 2060346 | 9/1992 | Canada | 206/386 |

OTHER PUBLICATIONS

Enpac, Advertising Brochure "Poly-Spillpallet", Mar. 1992, two pages.

ENPAC, Advertising brochure of multiple products, Dec. 1992, two pages.

New Pig, Product Data Sheet for Item #PAK423, Dec. 19, 1994, six pages.

*Primary Examiner*—Paul T. Sewell
*Assistant Examiner*—Luan K. Bui
*Attorney, Agent, or Firm*—J. P. Blasko Professional Corp.

[57] ABSTRACT

A hazardous material containment and storage unit is disclosed. The unit comprises a basin in which a plurality of molded plastic pods are positioned to form a support surface for placing containers of hazardous material such as conventional fifty-five gallon drums. Each pod may be molded form a collection basin so that only individual pods have to be removed and cleaned when a spill occurs. The containment tray formed by the basin and pods may be enclosed by a plurality of door structures pivotally attached to a door support arch. The vertical sides of the door support arch are positioned within recesses and attached to ledges on the outside surface of the basin. Each door structure has a top, side and front panel which covers a separate quadrant of the containment tray when the doors are closed. A pod for supporting a conventional drum in a generally horizontal orientation over the basin is also disclosed.

33 Claims, 9 Drawing Sheets

HAZARDOUS MATERIAL CONTAINMENT AND STORAGE UNIT

FIELD OF THE INVENTION

The present invention relates to a containment and storage device for hazardous material, more particularly, to a device for storing containers such as metal drums filled with hazardous material and for containing spillage that may occur from the containers.

BACKGROUND OF THE INVENTION

Worldwide industrialization has led to the increased use of materials which are environmentally unsafe and which in some cases are extremely toxic to humans. Although the problems associated with toxic waste have been known for some time, the severity of the situation has only been recognized in the last few years with the result being that legislation has been passed in the United States of America and in many other countries which provides stringent requirements regarding the collection, shipping, containment and storage of hazardous materials. Collection of hazardous materials in storage drums has become commonplace, but the drums can easily develop leaks over time. Periodic inspection can locate slow leaks, but catastrophic failure of a drum can occur and result in spillage of a large quantity of hazardous material. During shipping of the storage drums leaks are more likely to occur due to the vibration and jostling which can occur during transport, and leaks during this time can result in extremely toxic material being released onto the highway or along the railway. After shipping, simply placing such drums on the ground or floor for storage is not acceptable as a certain percentage of the drums are likely to develop leaks which will contaminate the soil or building in which the drums are being stored. If the drums are stored in an outside location exposure to the elements (rain, wind, snow, ice) will tend to weaken the storage drum and will result in an increased probability of leakage.

Leakage of the drums during shipping and storage has been partially dealt with by the use of containment trays which will contain the contents of at least a single 55 gallon drum. Various containment trays have been developed and have features which include an elevated surface on which the storage drums (typically four) are placed, and forklift channels which allow the tray to be lifted by a conventional forklift. It is important to keep the height of the containment tray and elevated surface as low as possible, since a reduced height means a lower lifting distance and will also maintain a safe distance between the storage drum and the face of the worker. The elevated surface has been formed in a number of ways, most simply by placing a wooden pallet in the tray, or by the use of transverse bars or a grating which is supported by the edges of the tray. Because the grating or bars do not usually have sufficient strength to support the weight of the four drums, methods have been developed to support the gratings or bars in the center as well as the edges. The most common method is to provide indentations in the center of the tray bottom which rise to support the grating. The use of these support members requires a higher side wall in order to achieve the same or similar containment volume of the tray without internal support members. This results in raising the overall height of the support surface unless the perimeter dimensions of the tray are expanded. Expansion of the perimeter dimensions is not desirable, because it is customary to size the tray to conform with industry defined standards, i.e., the size of a typical pallet. Furthermore, a higher support surface results in greater difficulty or effort for loading drums of hazardous material onto the surface and potentially creates a less safe environment by raising the level of the drums closer to the face of the worker loading the drums onto the support surface.

When a leak in the drums occurs, hazardous material will spill into the containment tray. This typically requires the entire tray to be unloaded in order to clean the tray, particularly in the instance where the tray is not compartmented to contain the spill within a limited portion of the tray. Dividing the tray into discrete compartments necessarily reduces the containment volume of a tray having a given height, thereby necessitating an increase in the height of the side walls to maintain an equivalent volume capacity. Also, spillage is not always readily detectable, particularly when the spillage is slight, because the grate or other drum support surface obstructs the user's view into the bottom of the tray.

For protection of the storage drums from the environment, storage sheds have been developed in which storage drums can be pushed into, and which have elevated floors which allow collection of any leakage in the bottom of the storage shed. While these sheds do protect the drums from the elements, the additional step required in removing a drum from a containment tray to place it in a storage shed means putting the worker in close contact with the drum, and stressing the drum by lifting and/or pushing it.

For the foregoing masons, there is a need for a structure which can serve as both a containment tray having a relatively low drum support surface height and as the basis for a storage building which can be easily erected over the tray to protect the storage drums, as well as allowing periodic inspection to determine that there has been no leakage of the drums.

SUMMARY OF THE INVENTION

A hazardous material containment and storage unit is disclosed. The unit comprises a basin in which a plurality of molded plastic pods are positioned to form a support surface for placing containers of hazardous material such as conventional fifty-five gallon drums. Each pod may be molded form a collection basin so that only individual pods have to be removed and cleaned when a spill occurs. The containment tray formed by the basin and pods may be enclosed by a plurality of door structures pivotally attached to a door support arch. The vertical sides of the door support arch are positioned within recesses and attached to ledges on the outside surface of the basin. Each door structure has a top, side and front panel which covers a separate quadrant of the containment tray when the doors are closed. A pod for supporting a conventional drum in a generally horizontal orientation over the basin is also disclosed.

The present invention is directed to an apparatus which satisfies the need for a structure which can serve as both a containment tray having a low storage drum support surface height and as the basis for a storage building which can be easily erected over the tray to protect the storage drums. In at least one embodiment, the structure of the present invention also allows easy periodic inspection to determine that there has been no leakage of the drums. The apparatus comprises a basin which serves as a containment tray, one or more support pods positioned within the basin upon which the drums are placed, an arch support ledge which may be integrally attached to the basin, a door support arch which attaches to the arch support ledge by a convenient attachment means, and door structures which are hinged onto the door support arch such that upon closing of the door structures the drums are enclosed within the structure.

BRIEF DESCRIPTION OF THE DRAWINGS

These and other features, aspects, and advantages of the present invention will become better understood with regard to the following description, claims, and drawings where:

DETAILED DESCRIPTION OF PREFERRED EMBODIMENTS

Figure 1:
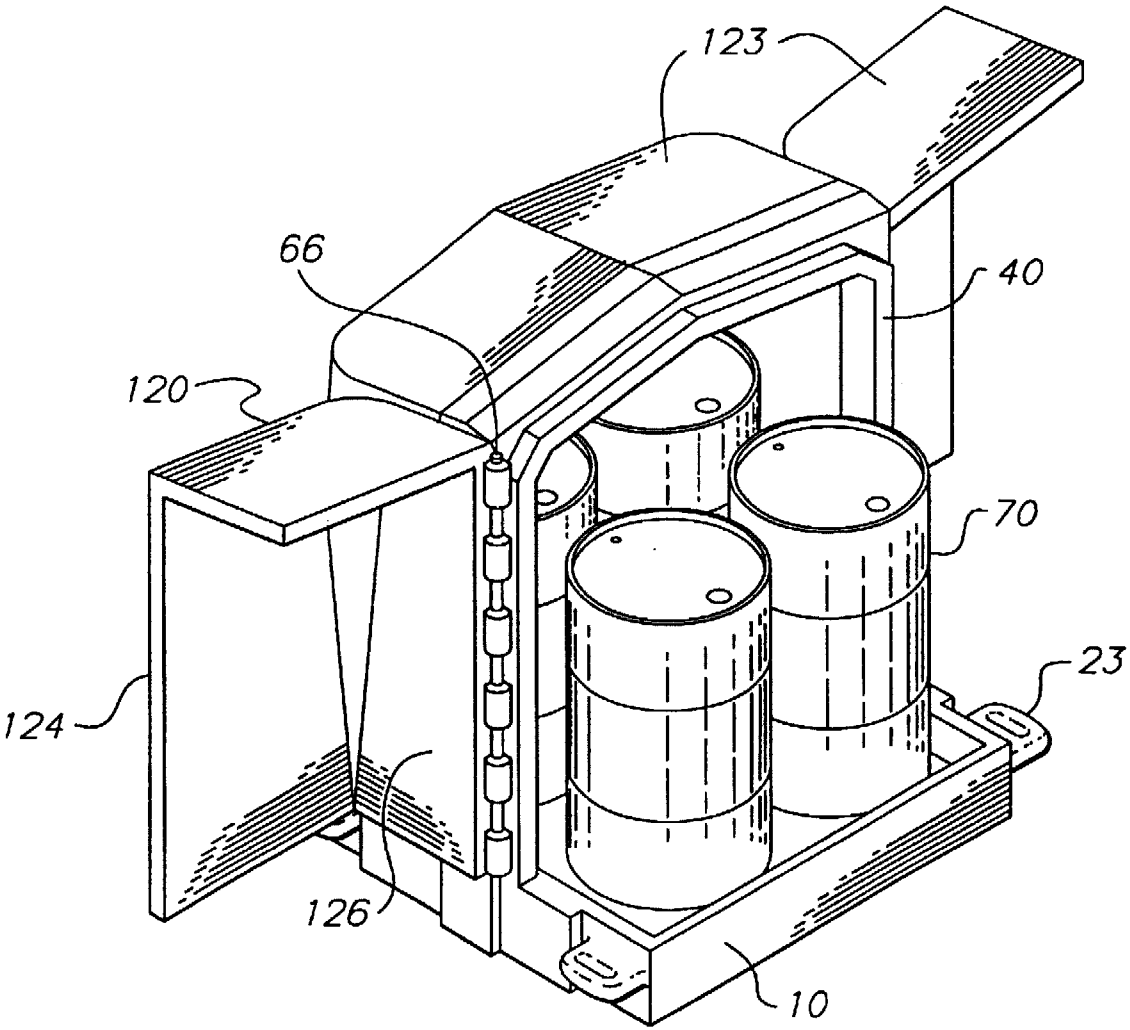
FIG. 1 illustrates the hazardous material containment and storage unit with four storage drums positioned therein.
Figure 3:
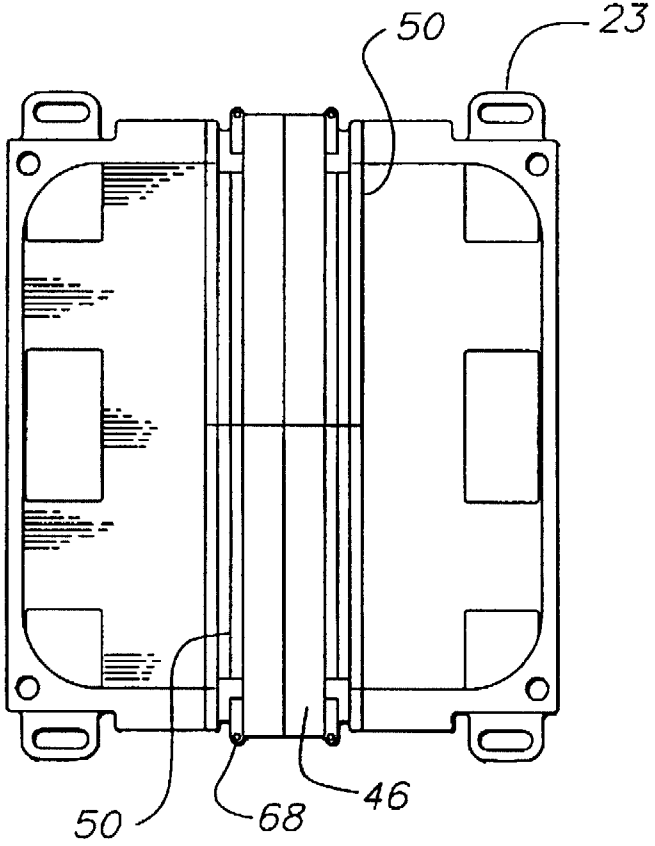
FIG. 3 illustrates a top view of the hazardous material containment and storage unit with the door structures and support pods removed.
Figure 2:
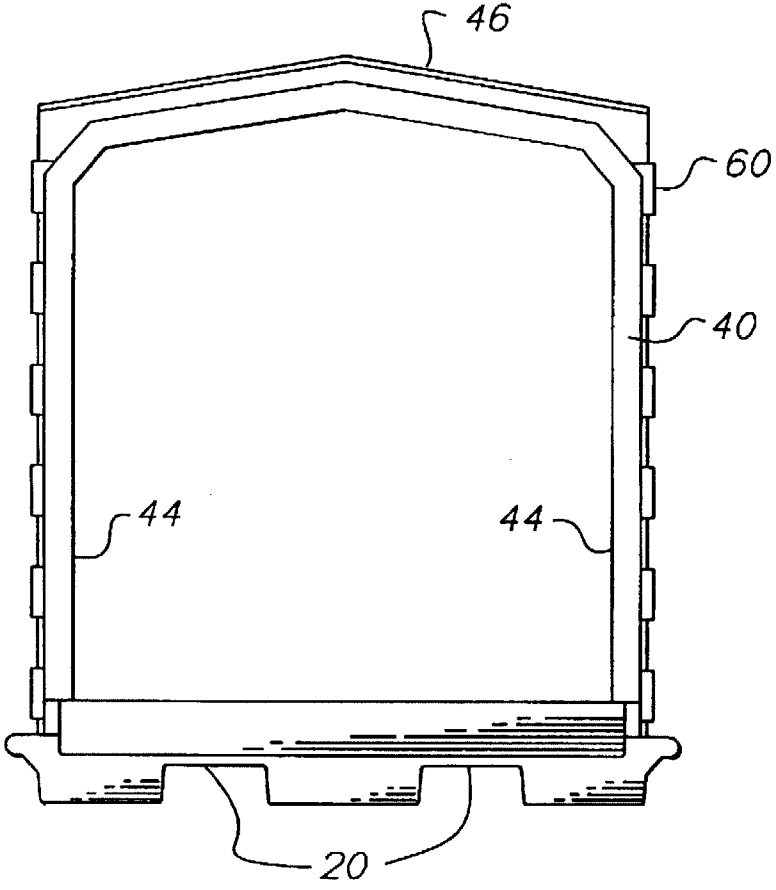
FIG. 2 illustrates a front elevation view of the hazardous material containment and storage unit with the door structures and support pods removed.

In describing the preferred embodiments of the invention illustrated in the drawings, specific terminology will be used for the sake of clarity. However, the invention is not intended to be limited to the specific terms so selected, and it is to be understood that each specific term includes all technical equivalents which operate in a similar manner to accomplish a similar purpose.

With reference to the drawings, in general, and FIGS. 1 through 17 in particular, the device of the present invention is disclosed.

As shown in FIG. 1, the hazardous material containment and storage unit comprises a basin 10 upon which is attached a door support arch 40. Door structures 120 are attached to the door support arch 40 by means of a hinge 60, which further comprises a hinge pin 66 which forms an axis about which the door structures 120 rotate and can be closed to protect drums 70. Handles 23 shown in FIG. 1 can be used for lifting or as a point for tying down the entire structure.

Figure 4:
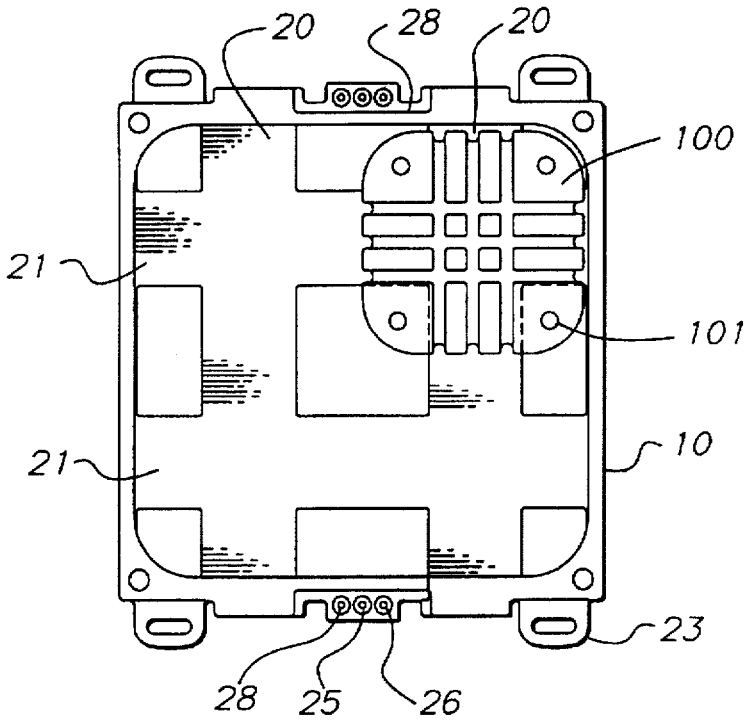
FIG. 4 illustrates a top view of the hazardous material containment and storage unit with the door support arch removed and one support pod positioned within the basin.
Figure 5:
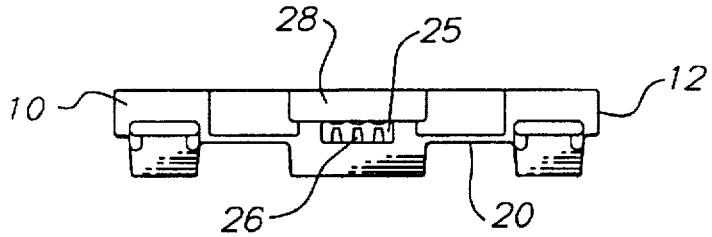
FIG. 5 illustrates a side view of the basin.

Further detail of the basin 10 shown in FIG. 1 is shown in FIG. 5 which is the side view of the basin 10 and clearly shows a bottom 11 which connects to the side 12; in addition there are first forklift channels 20 which are spaced such that a conventional forklift can lift the structure, and an arch support ledge 25 for attaching the door support arch by means of screws or bolts which enter door support arch fastening holes 26. The top view of the basin given in FIG. 4 shows the basin 10 with an integrally molded support pod 100. Four of these pods can be placed in the basin 10. Drums can then be placed on top of the pods. The combination of the pods in the basin forms a containment tray which has a volume sufficient to contain at least 55 gallons. The integrally molded pod 100 shown in FIG. 4 has at least one hole 101 which in the event of leakage from a drum will allow liquid to flow into the area underneath the integrally molded pod 101 and will allow air to flow out. FIG. 4 also illustrates the first forklift channels 20 as well as a second set of forklift channels 21 which allow the structure to be picked up by a forklift from any of the four sides. The arch support ledge 25 can be seen in FIG. 4 as well as the door support arch fastening holes 26. The ends vertical arch sides 44 of door support arch 40 are positioned within arch support recesses 28 and are fixedly attached to arch support ledges 25. The recesses 28 provide vertical stability for door support arch 40.

Figure 12:
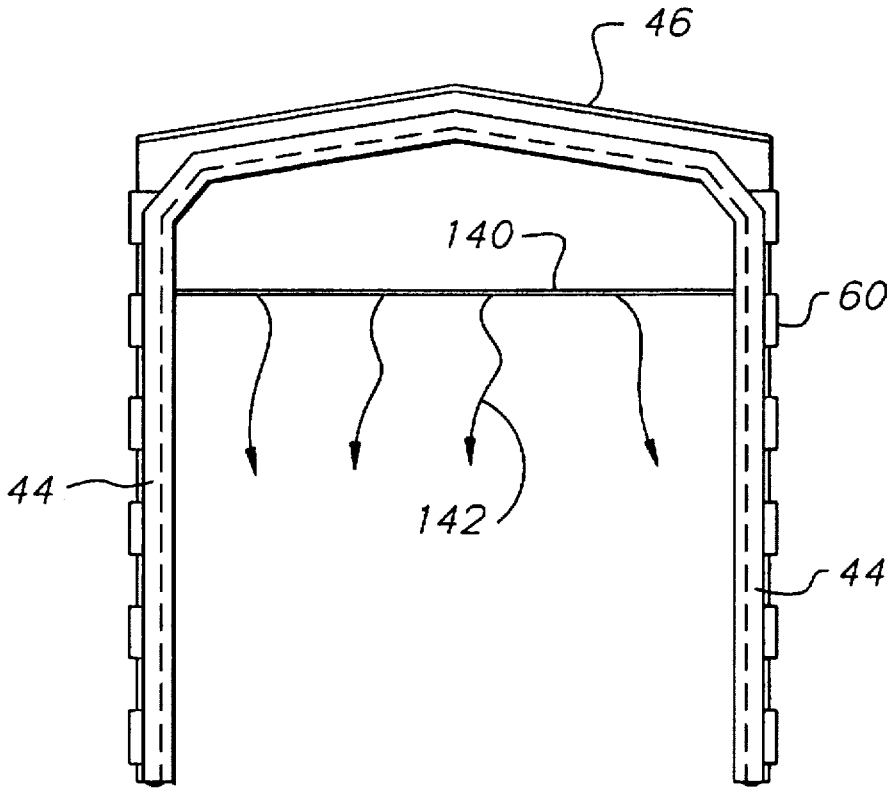
FIG. 12 illustrates a front elevation view of the door support arch.

It is possible to see how a door support arch 40, a front view of which is given in FIG. 12, can be mounted on basin 10 by means of the arch support ledge 25 and door support arch fastening holes 26. The door support arch 40 of FIG. 12 has arch fastener receiving holes 48 which permit the door support arch 40, when mounted on the arch support ledge 25, to be fixedly attached usually by means of bolts or screws which are accommodated by threads in the arch fastener receiving holes 48. This does not imply that the door support arch 40 needs to be fastened to the arch support ledge 25 by screw or bolt means, as any suitable means of attachment can be used including gluing or welding. Referring again to FIG. 12, the door support arch has vertical arch sides 44 and an arch top 46, and the hinge 60 to which the door structures are attached. It is also possible to include a storage shelf 140 in the door support arch 40 by fixedly attaching the shelf to the inner sides of the vertical arch sides 44 by suitable means which can include but is not limited to screwing, bolting, gluing or welding. Static grounding and bonding straps 142 can be attached to the shelf or another portion of the door support arch which can employ a conducting material to provide a path to ground so as to insure that the drums do not build up a large static charge which can be extremely dangerous in the case of flammable or explosive materials. A typical application of the static grounding and bonding straps 142 would be to connect them from a storage shelf 140 which is made out of a conducting material and which is connected by a copper wire or braided mesh wire to an external ground. This can be realized most simply by running the copper wire or braided mesh wire to outside of the containment and storage structure and grounding at a rod or simply by insuring contact with the earth. Contact with the earth does not always guarantee a good ground but in the case of materials which are not extremely flammable or explosive a grounding rod may not be necessary or required. The storage shelf 140 provides additional storage space for small cans of hazardous material or possibly safety equipment.

Figure 11:
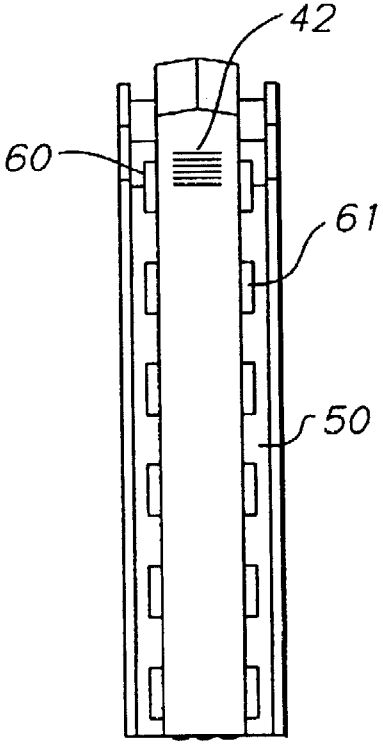
FIG. 11 illustrates a side elevation view of the door support arch.
Figure 10:
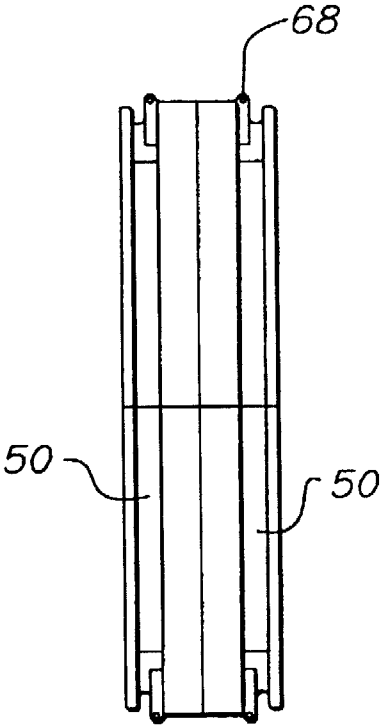
FIG. 10 illustrates a top view of the door support arch.
Figure 13:
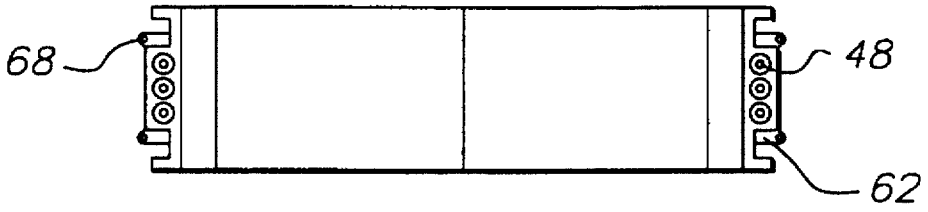
FIG. 13 illustrates a top view of the door support arch.

The bottom view of the door support arch shown in FIG. 13 illustrates the fastener receiving holes 48 and a hinge pin receiving hole 68. The top view of the door support arch given in FIG. 10 further illustrates the hinge pin receiving hole 68 of FIG. 13. The door support arch is typically hollow to reduce weight, and subsequently has an inner structure which can collect moisture or possibly condensed vapors from any leaked materials. As shown in FIG. 11 a side vent 42 is provided to allow moisture to escape.

By placing four pods in the basin 10 a containment structure is formed which provides leakage control for drums 70. Door support arch 40 may be attached to basin 10 by any suitable means such as bolts, clips and the like. A preferred attaching means is illustrated in FIGS. 4, 12 and 13. Vertical arch sides 44 of door support arch 40 are positioned within recesses 28 on the exterior side of the side walls of basin 10 and attached to the arch support ledge 25 by means of fastening devices entering the fastening holes 26 and terminating in the fastener receiving holes 48. This forms a rigid structure to which the door structures 120 can be attached by means of the hinge 60 and hinge pin 66. Also, any runoff from rain or the like is directed along channels 50 outside rather than into basin 10.

Figure 6:
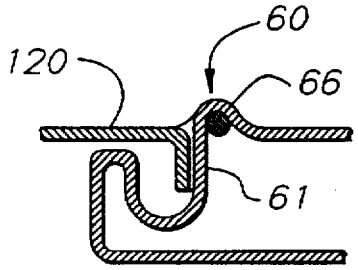
FIG. 6 illustrates a horizontal cross-sectional view of the hinge mechanism at a first location on the door support arch with the door structure in place.
Figure 7:
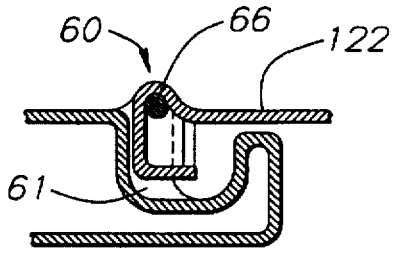
FIG. 7 illustrates a horizontal cross-sectional view of the hinge mechanism at a second location on the door support arch with the door structure in place.

The hinge 60 is formed by molding the door support arch 40 and door structures 120 in such a manner that complimentary hinge portions are formed. This is illustrated in FIG. 6 where a horizontal cross section of the hinge 60 at a first location on the door support arch 40 with the door structure 120 in place is shown and the door support arch hinge pin receiving portion 61 of the door support arch 40 can be seen forming part of a hinge which allows rotation of the door structure 120 about the hinge axis formed at the center of hinge pin 66 which passed through the door support arch hinge receiving portion 61. In FIG. 7 a horizontal cross section of the hinge 60 at a second location on the door support arch 40 is shown where the door structure hinge pin receiving portion 122 receives hinge pin 66. The hinge 60 is formed between the alternating sections shown in FIG. 6 and FIG. 7 because the hinge pin 66 passes through receiving portions in both the door support arch 40 and the door structure 120. Once the door structures 120 are in place, they can be rotated about the hinge axis formed at the center of hinge pin 66 and be closed to protect the drums from the elements. The hinges is positioned within drainage slots 50. Preferably, drainage slots 50 extend the entire length of door support arch 40. Because the vertical arch sides 44 are mounted on the outer side of basin 10 in recesses 28 on arch ledges 25, water from rain and the like is drained outside of the structure rather than into basin 10.

Each doors structure 120 has a door top panel 123 integrally attached to a door side panel 126 and a door front panel 124. In combination with the hinge mounted on the vertical arch sides 44, this configuration for door structures 120 facilitates unencumbered access by a worker to substantially the whole drum stored within the quadrant. When the door structures are closed, they form the four sides and roof of the storage unit. Since each door structure allows access to a separate quadrant, it is not necessary to move or remove a drum in order to gain access to adjacent drums. Furthermore, it is not necessary to incorporate additional space within the structure to allow the worker to enter into the structure as is the case in previously known storage sheds. This feature also enhances the safety of the storage unit of the present invention, since the worker is not required to enter into a shed which is potentially inadequately ventilated.

A door locking mechanism may be comprised of two metal structures which permit the insertion of a traditional lock structure with a combination or a key, or a more complicated door locking mechanism which is molded into the door structures themselves. The type of locking mechanism will depend on the degree of security that is desired and the exact mechanism used is not critical to the description of the hazardous material containment and storage unit provided here. A placard holding mechanism (not shown) may be fixedly attached to one or more door structures which allows placement of descriptive signs or literature which describes the content and handling precautions of the hazardous material stored inside the unit. This is a particularly attractive feature since it enhances worker safety by insuring that there is a place for identifying the material. The placard holding mechanism may be a slotted frame which is molded into the door structures 120 or can be a frame which is glued to the door structure 120. The exact type of placard holding mechanism is not critical to the invention but its incorporation into a door structure 120 provides for easy identification of the contents of the containment and storage unit.

Figure 8:
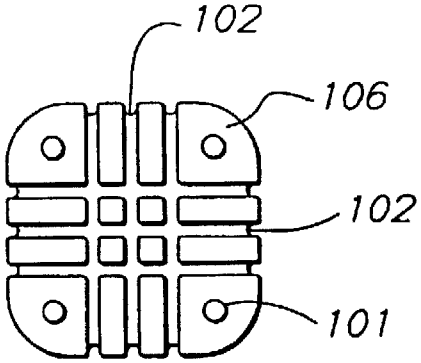
FIG. 8 illustrates a top view of an integrally molded support pod.
Figure 9:
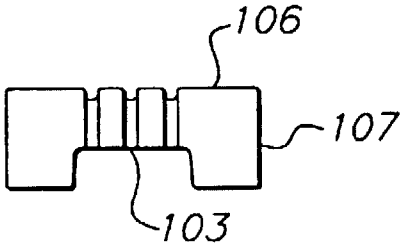
FIG. 9 illustrates a side elevation view of an integrally molded support pod.

In this unit there are several possible embodiments for the support pods upon which the drums rest. It is possible to make support pods in a single manufacturing step resulting in an integrally molded support pod 100 as shown in FIG. 4. The top view of this integrally molded support pod 100 is shown in FIG. 8 and illustrated the top surface 106 as well as channels 102 which permit drainage of liquids from leaks on the bottom of a drum and holes 101 which permit air to escape as liquid begins to accumulate underneath the pod. The side view of the integrally molded support pod is shown in FIG. 9 where both the top surface 106 and side 107 can be seen. Molded indentations 103 are also shown in FIG. 9 and correspond to the indentations in the bottom 11 of basin 10 which form either the first channels 20 or second channels 21 which permit lifting of the structure by a forklift. If both first and second channels are present in the basin 10 the side view of the integrally molded pod 100 will be the same on all four sides. The pod is preferably molded from polyethylene by rotational molding or injection molding. The principal advantages of the integrally molded pod are the ease in manufacturing, its light weight and low displacement volume within the basin, and the ability to nest the pods when not being used.

Figure 14:
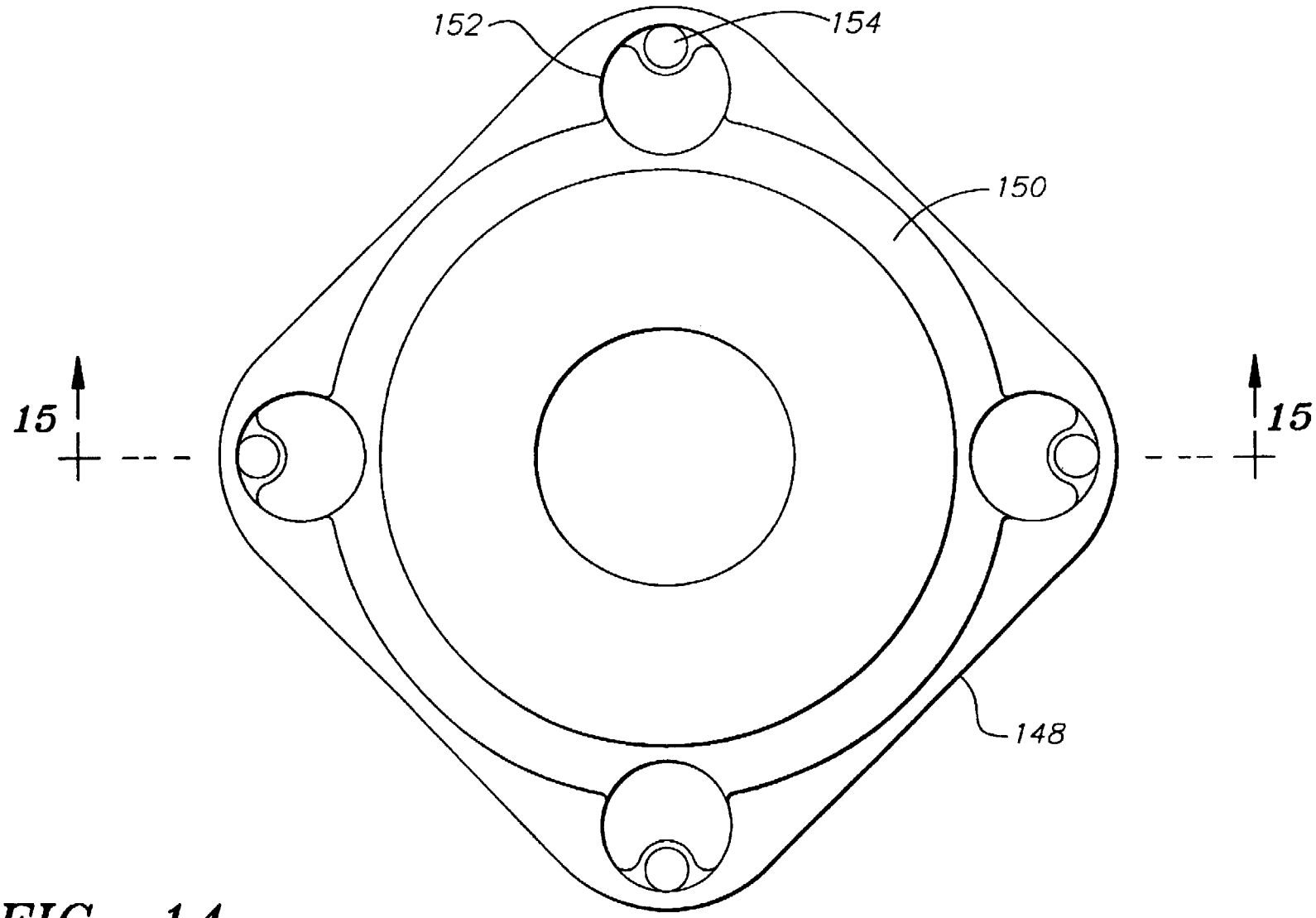
FIG. 14 illustrates a top view of a support and containment pod.
Figure 15:
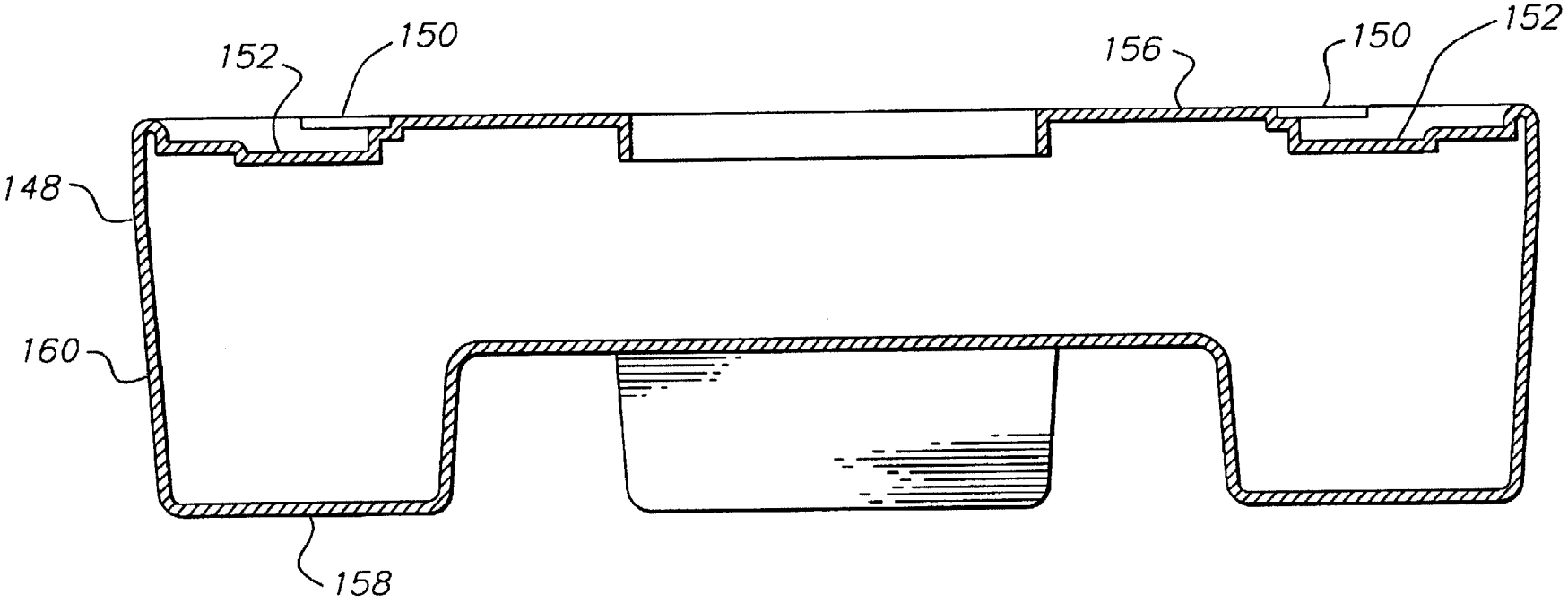
FIG. 15 illustrates a side cross-sectional view of a support and containment pod taken at line 15—15.
Figure 16:
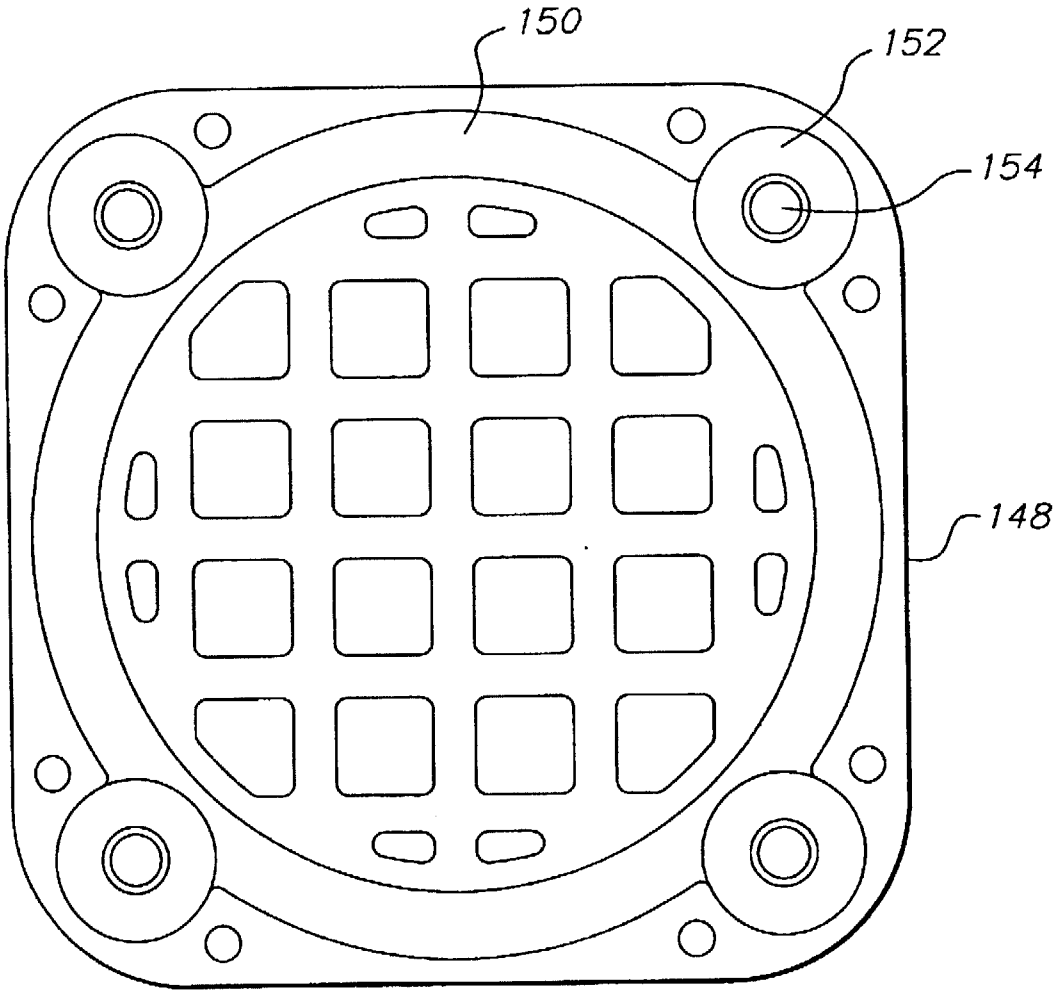
FIG. 16 illustrates a top view of an alternative embodiment of the support and containment pod.
Figure 17:
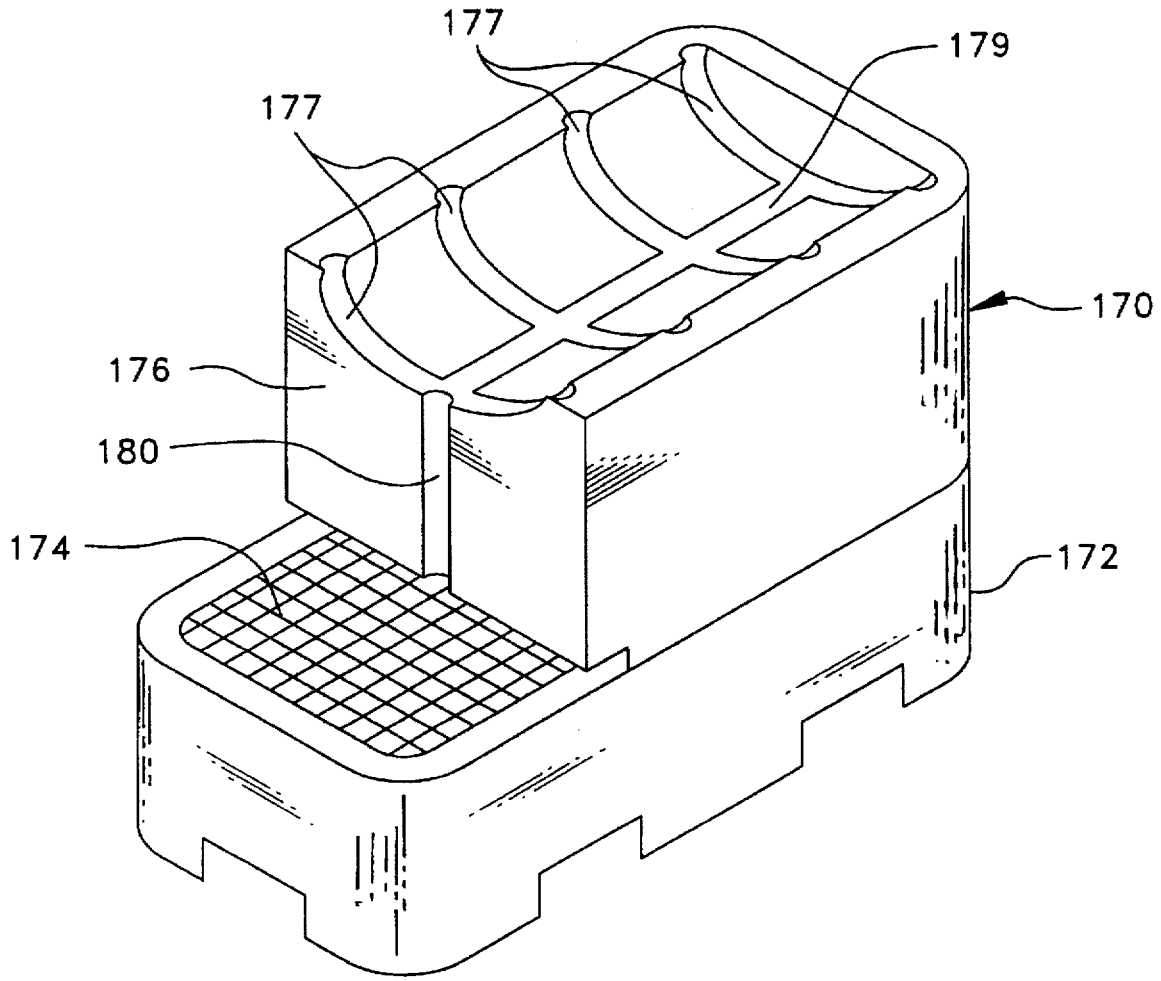
FIG. 17 illustrates a perspective view a support and containment pod adapted to support a storage drum in a generally horizontal orientation.

An alternative form of pod is the support and containment pod 148 pod, a top view of which is shown in FIG. 14, and a vertical cross section being shown in FIG. 15. Referring to FIG. 15 the support and containment pod 148 comprises a bottom surface 158 and a side surface 160 which are joined to form a leakproof container. The top surface 156 comprises a recessed support channel 150 which receives the rim of a drum, effectively preventing it from moving, and directs spillage to a spill monitoring reservoir 152. Reservoirs 152 collect leakage from a drum and provide a convenient means for identifying if there has been leakage from a particular drum. The corresponding top view of the support and containment pod 148 in FIG. 14 shows the recessed support channel 150, the spill monitoring reservoir 152 and a drainage hole 154. The drainage hole is of critical importance since only a small amount of liquid can be contained in the spill monitoring reservoir. Excess liquid flows down the drainage hole 154, the opening of which is a few millimeters above the bottom of the spill monitoring reservoir 152. In this way a small amount of liquid remains in spill monitoring reservoir 152, but the excess flows into the support and containment pod 148 associated with the drum that has the leak. The advantage of the support and containment pod 148 is that it allows monitoring of leaks and maintains the leaked liquid within a container and does not contaminate the entire basin. In the event that a few gallons leak it is possible to contain the liquid within support and containment pod 148 and remove the leaking drum and support and containment pod 148. In the event of catastrophic failure of a drum, the support and containment pod 148 associated with that drum overflows and the excess overflow is contained within basin 10 and other support and containment pods. FIG. 17 illustrates a support pod 170 which is adapted to support a conventional drum in a generally horizontal orientation. The base 172 of support pod 170 is adapted to be positioned within approximately on half&the basin 10. Base 172 may be open to basin 10 or may have an integrally attached bottom to form a reservoir for containing spillage. Drum support portion 176 positioned above base 172 is adapted to receive the side of a conventional fifty-five gallon drum. Cross channels 177 serve to channel spillage to main channel 179 which is oriented lengthwise below the drum when it is in position on the drum support portion 176. Drain channel 180 directs spillage from main channel 179 through grate 174 into basin 10 or, alternatively, into base 172 when the bottom of base 172 is enclosed to form a containment pod.

There are a number of clear advantages to this invention which can be seen by considering the use of the disclosed containment and storage unit. A basin is configured with support pods of the integrally molded support type or of the support and containment type, depending on the requirements for ease of monitoring leakage of drums. When placed in the basin the pods cannot move substantially because their sides are adapted to be positioned within the recesses formed by the forklift channels. Drums containing hazardous materials can be loaded onto the support pods by workers or by automated lifting equipment. Because the pods are designed to have a low displacement volume, the overall height of the basin with pods is kept to a minimum, which makes for ease of lifting the drums and maintains a safe distance between the drum surface and the face of the worker. A forklift can be used to lift the basin and drums and load them onto a truck, train or boat for shipping. Upon arrival at their destination, the basin and drums can be unloaded. If the basin and drums are to be stored for a long period of time (typically years) it may be necessary to enclose the drums. At this point a door support arch can be attached to the arch support ledge, and door structures can be added. The drums can be grounded using the grounding and bonding strap which is attached to the storage shelf. Additional materials can be stored in the storage shelf if required. At this point the door structures can be closed and locked. Information regarding the contents and inspection dates can be placed on a placard which is held in the placard holding mechanism on the door structures. At periodic inspection dates, the door structures can be opened and if the support and containment pods are used a visual inspection of the spill monitoring trench will indicate a particular drum is leaking.

Although the present invention has been described in considerable detail with reference to certain preferred version thereof, other versions are possible. For example: the sequence of events described in the previous paragraph are only exemplary and it is possible add the door structures immediately after loading of the basin with support pods so as to provide a closed container for shipping of the drums. Therefore, the spirit and scope of the appended claims should not be limited to the description of the preferred versions contained herein.

What is claimed is:

1. A containment and storage device for hazardous material comprising:

a) a basin for containing spillage of hazardous material, said basin having a bottom, a plurality of side walls integrally attached to and surrounding the periphery of said bottom, and at least one pair of parallel, transverse channels sized and configured to received the forks of a forklift beneath the bottom of said basin, thereby forming subchambers within said basin;

b) a plurality of support pods positioned within said basin, each pod having a top support surface attached to a support member forming the side wall of the pod for supporting said top support surface above the bottom of said basin, the lower edge of said side wall being configured to rest on the top surface of at least one transverse channel and the bottoms of the adjacent subchambers.

2. The containment and storage device of claim 1, wherein said support pods are substantially unattached to said basin and are manually removable therefrom.

3. The containment and storage device of claim 1, wherein at least one of said support pods further comprises a floor integrally attached to said side wall and configured to form a secondary containment chamber and a means for directing spillage into said secondary containment chamber.

4. The containment and storage device of claim 3, wherein said means for directing spillage into said secondary containment chamber is an aperture in the top surface of said support pod.

5. The containment and storage device of claim 3, wherein at least one of said pods comprises a spillage detecting means.

6. The containment and storage device of claim 5, wherein said spillage detecting means comprises a spillage reservoir.

7. The containment and storage device of claim 6, wherein said spillage detecting means further comprises at least one channel for directing spillage to said reservoir.

8. The containment and storage device of claim 1, wherein each of said support pod is an integrally molded monolithic unit.

9. The containment and storage device of claim 1, wherein said support pods are molded from polyethylene.

10. The containment and storage device of claim 1, wherein said device comprises four support pods and said basin has a substantially rectangular peripheral configuration.

11. The containment and storage device of claim 10, wherein each support pod is configured to support containers of hazardous material within one quadrant of said basin.

12. The containment and storage device of claim 3, wherein said support pods are substantially unattached to said basin and are manually removable therefrom.

13. The containment and storage device of claim 1, wherein at least one of said pods comprises a spillage detecting means.

14. The containment and storage device of claim 13, wherein said spillage detecting means comprises a spillage reservoir.

15. The containment and storage device of claim 14, wherein said spillage detecting means further comprises at least one channel for directing spillage to said reservoir.

16. The containment and storage device of claim 1, wherein said top surface is configured to support a cylindrical container with the container's vertical axis in a generally horizontal orientation.

17. The containment and storage device of claim 16, wherein at least one of said support pods further comprises a floor integrally attached to said side wall and configured to form a secondary containment chamber and a means for directing spillage into said secondary containment chamber.

18. The containment and storage device of claim 3, wherein each of said support pods is an integrally molded monolithic unit.

19. The containment and storage device of claim 11, wherein said basin comprises a first and second pair of parallel transverse channels sized and configured to receive the forks of a forklift, said second pair of channels being oriented generally perpendicular to said first pair of channels.

20. A containment and storage device for hazardous material comprising:

a containment tray having a basin, said basin having a bottom and at least one side wall extending about the periphery of said bottom;

a door support arch comprising a pair of vertical support sides and a top support attached to the upper end of each vertical support side, the lower end of each vertical support side being attached to said side wall of said basin;

a plurality of door structures, each of said door structures being pivotally attached to a vertical support side.

21. The containment and storage device of claim 20, wherein said lower ends of said vertical support sides are attached to the exterior side of said basin side wall.

22. A containment and storage device for hazardous material comprising:

a containment tray having a basin, said basin having a bottom and at least one side wall extending about the periphery of said bottom;

a door support arch comprising a pair of vertical support sides and a top support attached to the upper end of each vertical support side, the lower end of each vertical support side being attached to said side wall of said basin;

a plurality of door structures, each of said door structures being pivotally attached to a vertical support side;

wherein said lower ends of said vertical support sides are attached to the exterior side of said basin side wall and said lower ends are positioned within vertical support means on said side wall.

23. The containment and storage device of claim 22, wherein said vertical support means comprises a recess on the exterior side of said side wall.

24. The containment and storage device of claim 22, wherein said lower ends of said vertical support sides rest on ledge means attached to said side wall below said lower ends of said vertical support sides.

25. A containment and storage device for hazardous material comprising:

a containment tray having a basin, said basin having a bottom and at least one side wall extending about the periphery of said bottom;

a door support arch comprising a pair of vertical support sides and a top support attached to the upper end of each vertical support side, the lower end of each vertical support side being attached to said side wall of said basin;

a plurality of door structures, each of said door structures being pivotally attached to a vertical support side by hinge means positioned within a corresponding vertical channel on the exterior side of said vertical support side.

26. A containment and storage device for hazardous material comprising:

a containment tray having a basin, said basin having a bottom and at least one side wall extending about the periphery of said bottom;

a door support arch comprising a pair of vertical support sides and a top support attached to the upper end of each vertical support side, the lower end of each vertical support side being attached to said side wall of said basin;

a plurality of door structures, each of said door structures being pivotally attached to a vertical support side;

wherein said basin comprises at least one pair of parallel, transverse channels sized and configured to receive the forks of a forklift beneath the bottom of said basin, thereby forming subchambers within said basin; and said containment tray further comprises a plurality of support pods positioned within said basin, each pod having a top support surface attached to a support member forming the side wall of the pod for supporting said top support surface above the bottom of said basin, the lower edge of said side wall being configured to rest on the top surface of at least one transverse channel and the bottoms of the adjacent subchambers.

27. The containment and storage device of claim 26, wherein at least one of said support pods further comprises a floor integrally attached to said at least one side surface and configured to form a secondary containment chamber and a means for directing spillage into said secondary containment chamber.

28. A containment and storage device for hazardous material comprising:

a containment tray comprising a basin having a substantially rectangular peripheral configuration, said basin having a bottom and a plurality of side walls extending about the periphery of said bottom;

a door support arch comprising a pair of vertical support sides and a top support attached to the upper end of each vertical support side, the lower end of each vertical support side being attached to the center of corresponding parallel side walls;

a plurality of door structures, each of said door structures having a side panel pivotally attached to a vertical support side along a first side edge of said side panel, a front panel attached to the second side edge of said side panel and a top panel having adjacent edges attached to the top edges of said side and front panels.

29. A containment and storage device for hazardous material comprising:

a containment tray comprising a basin having a substantially rectangular peripheral configuration, said basin having a bottom and a plurality of side walls extending about the periphery of said bottom;

a door support arch comprising a pair of vertical support sides and a top support attached to the upper end of each vertical support side, the lower end of each vertical support side being attached to the center of corresponding parallel side walls;

a plurality of door structures, each of said door structures having a side panel pivotally attached to a vertical support side along a first side edge of said side panel, a front panel attached to the second side edge of said side panel and a top panel having adjacent edges attached to the top edges of said side and front panels;

wherein said device comprises four door structures and each of said door structures encloses one quadrant of the containment tray when said door structure are in a closed position.

30. A containment and storage device for hazardous material comprising:

a containment tray comprising a basin having a substantially rectangular peripheral configuration, said basin having a bottom and a plurality of side walls extending about the periphery of said bottom;

a door support arch comprising a pair of vertical support sides and a top support attached to the upper end of each vertical support side, the lower end of each vertical support side being attached to the center of the exterior side of corresponding parallel side walls;

a plurality of door structures, each of said door structures having a side panel pivotally attached to a vertical support side along a first side edge of said side panel, a front panel attached to the second side edge of said side panel and a top panel having adjacent edges attached to the top edges of said side and front panels.

31. The containment and storage device of claim 30, wherein said lower ends are positioned within vertical support means on said side wall and rest on ledge means attached to said side walls below said lower ends of said vertical support sides.

32. A containment and storage device for hazardous material comprising:

a containment tray comprising a basin having a substantially rectangular peripheral configuration, said basin having a bottom and a plurality of side walls extending about the periphery of said bottom and at least one pair of parallel, transverse channels sized and configured to receive the forks of a forklift beneath the bottom of said basin, thereby forming subchambers within said basin, and said containment tray further comprises a plurality of support pods positioned within said basin, each pod having a top support surface attached to at least one side surface for supporting said top support surface above the bottom of said basin, the lower edge of said side surface being configured to rest on the top surface of at least one transverse channel and the bottoms of the adjacent subchambers;

a door support arch comprising a pair of vertical support sides and a top support attached to the upper end of each vertical support side, the lower end of each vertical support side being attached to the center of corresponding parallel side walls;

a plurality of door structures, each of said door structures having a side panel pivotally attached to a vertical support side along a first side edge of said side panel, a front panel attached to the second side edge of said side panel and a top panel having adjacent edges attached to the top edges of said side and front panels.

33. The containment and storage device of claim 32, wherein at least one of said support pods further comprises a floor integrally attached to said at least one side surface and configured to form a secondary containment chamber and a means for directing spillage into said secondary containment chamber.

* * * * *